United States Patent [19]

Pfarrwaller

[11] 4,192,354

[45] Mar. 11, 1980

[54] SHUTTLE SENSING MEANS FOR WEAVING MACHINE CATCHER MECHANISM

[75] Inventor: Erwin Pfarrwaller, Winterthur, Switzerland

[73] Assignee: Sulzer Brothers Limited, Winterthur, Switzerland

[21] Appl. No.: 910,088

[22] Filed: May 26, 1978

[30] Foreign Application Priority Data

Jun. 1, 1977 [CH] Switzerland ..... 006707/77

[51] Int. Cl.[2] ..... D03D 51/40

[52] U.S. Cl. ..... 139/342; 139/439

[58] Field of Search ..... 139/185, 186, 187, 341, 139/342, 343, 437, 438, 439

[56] References Cited

U.S. PATENT DOCUMENTS

| | | | |
|---|---|---|---|
| 3,124,166 | 3/1964 | Pfarrwaller | 139/185 |
| 3,895,657 | 7/1975 | Bilelc | 139/342 |

FOREIGN PATENT DOCUMENTS

| | | | |
|---|---|---|---|
| 836026 | 4/1952 | Fed. Rep. of Germany | 139/342 |
| 552090 | 7/1974 | Switzerland | 139/342 |

*Primary Examiner*—Henry Jaudon

*Attorney, Agent, or Firm*—Kenyon & Kenyon

[57] ABSTRACT

A catcher mechanism for the weft picking means of a weaving machine which facilitates higher machine speed. Included in the catcher mechanism is a picking means brake, a sensing element movable into the path of the picking means, and a push-back member for pushing the picking means away from its stop position and into a yarn release position. The sensing element has the end thereof adjacent the picking means in engagement with a spring member so that the sensing element is movable along with the push-back member in the push-back direction, such movement being against the force of the spring.

7 Claims, 4 Drawing Figures

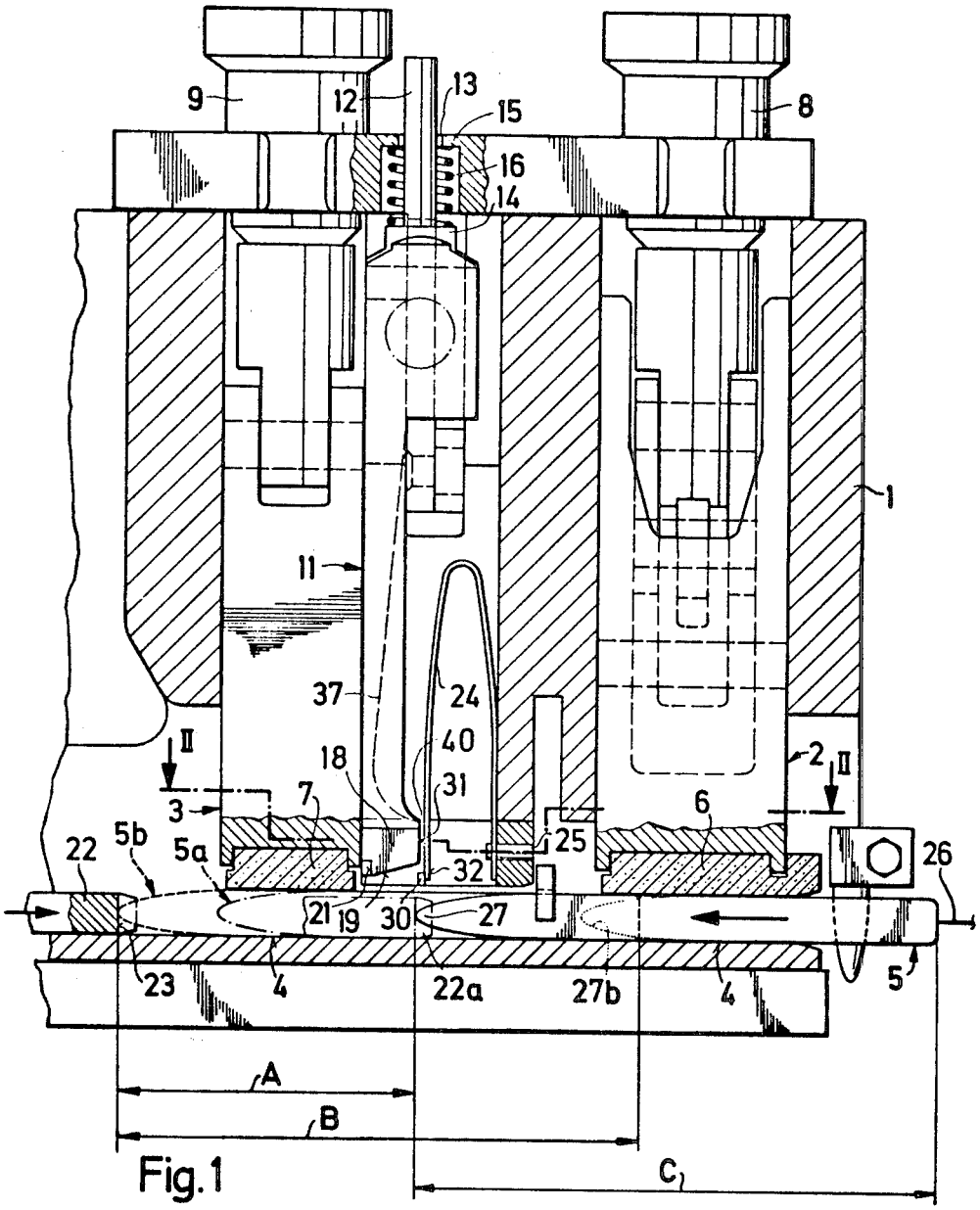
Fig.1
Fig.2
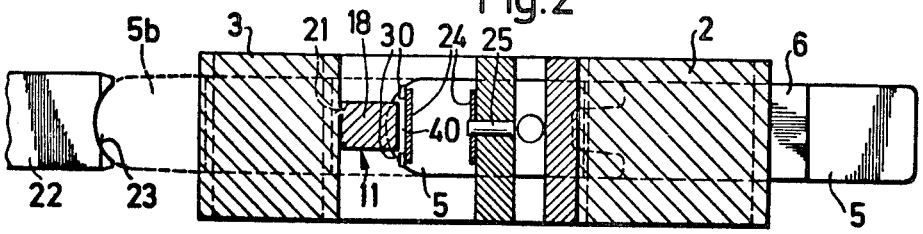

SHUTTLE SENSING MEANS FOR WEAVING MACHINE CATCHER MECHANISM

BACKGROUND OF THE INVENTION

This invention relates generally to weaving machines and more particularly to an improved catcher mechanism for the weft picking means.

A catcher mechanism for the weft picking means of a weaving machine generally includes a braking mechanism for the picking means, a sensing element movable into the path of the picking means, and a push-back member for pushing the picking means back from its stop position into a yarn release position. A known catcher mechanism of this type is described in German Patent Spec. 836 026. Therein, the sensing element consists of a pin, which is guided in the catcher mechanism housing, the end of which senses the picking means at a specific time during the weaving machine operating cycle. Consequently, after each weft picking operation there is a check on whether the picking means has properly entered the catcher mechanism.

One disadvantage of such prior art catcher mechanisms is that the sensing pin is disposed beyond the path of the push-back member, namely the pin is disposed beyond the path of the push-back member moving in the direction to return the picking means. This is necessary to ensure that the sensing means does not project into the path of the push-back member and collide therewith if the picking means is absent.

Accordingly, it is an object of this invention to provide an improved catcher mechanism which overcomes the drawbacks of the prior art.

It is another object of this invention to provide a catcher mechanism which facilitates higher speed operation of a weaving machine.

It is a further object of this invention to provide an improved weaving machine catcher mechanism permitting greater travel of the picking means prior to sensing.

It is another object of the invention to provide a catcher mechanism for a picking means of a weaving machine with a sensing means for the picking means which can move with a push-back member.

SUMMARY OF THE INVENTION

Briefly stated, the present invention relates to the catcher mechanism for the weft picking means (e.g. a shuttle) of a weaving machine. More particularly, the catcher mechanism includes a braking mechanism for the picking means, a sensing element movable into the path of the picking means, and a push-back member for pushing the picking means back from a stop position into a yarn release position. The end portion of the sensing element disposed adjacent the picking means is resiliently movable in the direction of the push-back path of the push-back member.

In one embodiment, the sensing element is mounted in a housing of the catcher mechanism adjacent a spring member and in the path of the push-back member, namely that portion of the path in which the push-back member would be moving back a picking means. The sensing element is also pivotally mounted so that a sensing portion or end of the sensing element can be urged by the push-back member adjacent the spring member. Preferably, a stop member is provided for limiting the travel of the spring in order to relieve the load on the sensing element under normal operation.

Because the sensing element is resiliently movable in the direction of the push-back movement of the push-back member and is disposed in the zone or range of the push-back path of the push-back member the amount of travel of the picking means within the catching mechanism can be increased. More specifically, the travel of the picking means within the catching mechanism may be up to and beyond the sensing point thus increasing the chances for stopping the machine in case of a fault. In turn, this has the effect that the picking means is sensed at a location in the catcher mechanism which is situated farther inwardly thereof than was the case with prior art arrangements. The rearward end of the picking means is thus permitted to enter the catcher mechanism a sufficient distance at the time of sensing so as to avoid collision with other movable elements of the weaving machine, e.g. the selvage yarn clip, the reed, the picking means guide, and so on, disposed on the picking line near the catcher mechanism. Therefore, there is no longer a risk that the machine would continue to run if the rear end of a shuttle is disposed in the collision zone of the various elements on the catcher side.

In another embodiment, the sensing element is provided with a pivotally mounted sensing member of the sensing portion so that only this sensing member need be pivoted by the push-back member during operation.

In still another embodiment, the sensing element is made of a resilient material and is fixedly mounted at one end so that the entire element can be flexed by the push-back member during operation.

According to the invention, the end of the picking movement may be located at a later point in the cycle. Hence, the end of the picking movement may be located at a higher main shaft angle relative to the movement of the various other elements on the catcher side, since the susceptibility of the picker means colliding with these members has been eliminated. The picking time is dependent only on the picking mechanism and is therefore always constant. The higher main shaft angle at the time when the picking movement is concluded also occurs with a correspondingly higher machine speed so that the weft picking speed is increased.

The invention will be described in detail with reference to the drawings and the following description of exemplified embodiments.

BRIEF DESCRIPTION OF THE DRAWINGS

FIG. 1 is an elevation view, partly in cross-section of a portion of the gripper shuttle weaving machine catcher mechanism constructed according to the invention;

FIG. 2 is a simplified cross-section taken along the line II—II of FIG. 1;

DESCRIPTION OF THE PREFERRED EMBODIMENT

Figure 3:
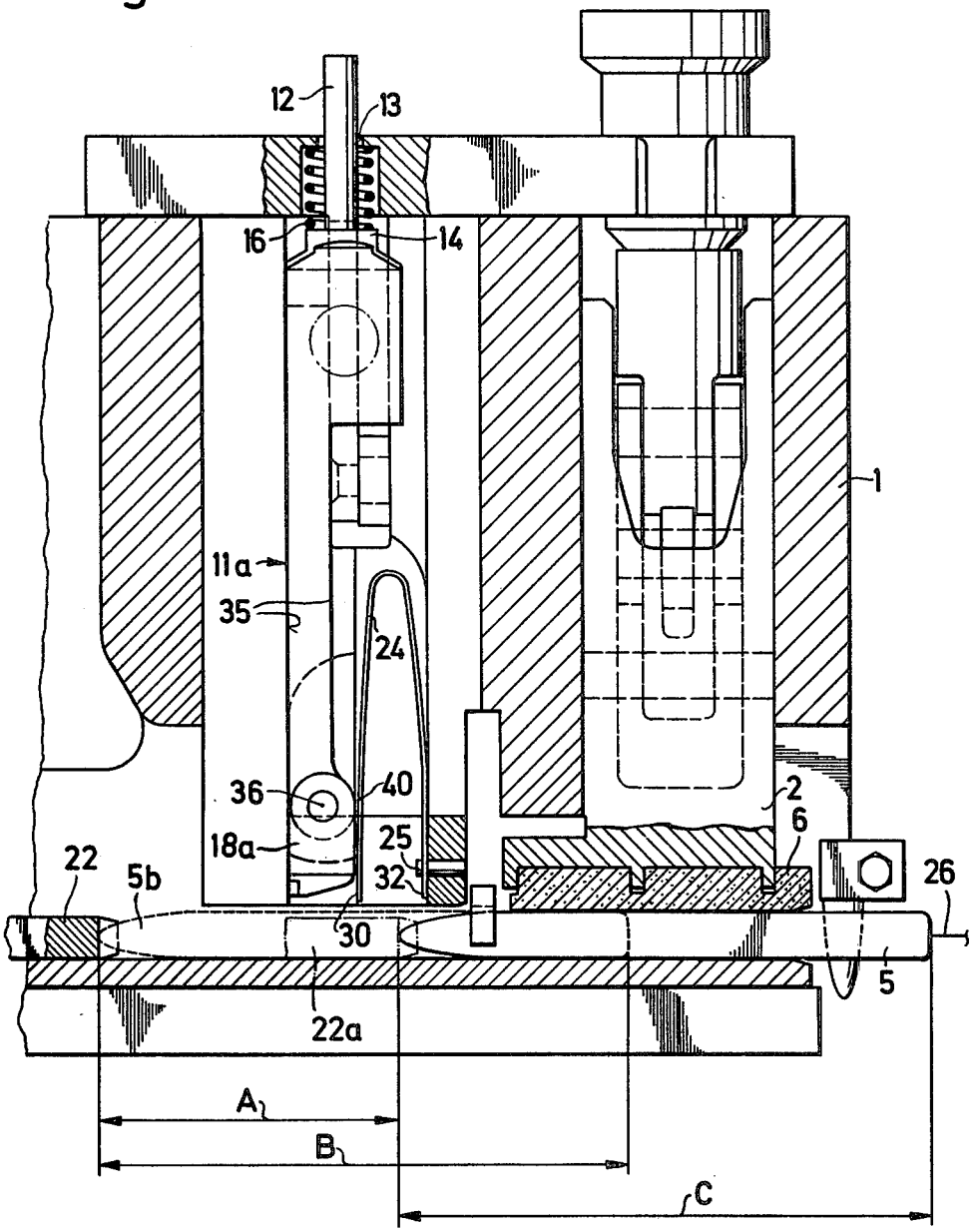
FIG. 3 is an elevation view, partly in cross-section, of a portion of a modified embodiment of the gripper shuttle weaving machine catcher mechanism according to the invention.

The catcher mechanism is of generally known construction e.g. as described in U.S. Pat. No. 2,538,798 and has a housing 1 in which a braking means is mounted.

This braking means includes a primary brake 2 and an additional brake 3 each disposed adjacent an entry path 4 of a weft picking member such as a gripper shuttle or projectile 5. The brakes 2, 3 have brake jaws 6, 7 respectively with the primary brake 2 and the associated brake jaw 6 exerting a greater braking force on the shuttle 5. The brakes 2, 3 are adjustable by screw means 8, 9 respectively and serve to brake the shuttle 5 to a stop position.

A sensing element is also mounted in the housing 1 after the primary brake 2 and has a pin 12 projecting through an opening in the catcher mechanism housing 1. The opening is larger than the diameter of pin 12 so that a clearance 13 is provided between the pin 12 and housing 1. The sensing element 11 also includes a shoulder 14 at the base of projecting pin 12. A spring 16 is disposed between the shoulder 14 and another shoulder 15 in the catcher mechanism housing 1 and urges the sensing element 11 to move in a downward direction as viewed in FIG. 1. Such downward movement takes place upon release of a locking member associated with sensing element 11.

The sensing element 11 has a sensing portion 18 at the lower end which is formed as a foot with an inclined surface 19 at the bottom and a curved recess 21 as indicated in FIG. 2.

A push-back element is also mounted in the housing 11 as is known for pushing a stop shuttle 5 located in a push-back zone A into a yarn release position C. The push-back member 22 is movable along the entry path 4 and is adapted to engage the recess 21 in the sensing element 11—in the absence of a shuttle 5—with a forward portion thereof of a curved recess 23 (FIG. 2).

A leaf spring 24 is also fixed to the catcher mechanism housing 1 at 25 adjacent to the spring element 11. The travel of the spring 24 is limited by a fixed stop 30 which abuts a free end 32 of the spring 24 so that during normal operation the sensing element 11 is not subjected to the force of the spring 24 and, if required, a slight clearance 40 depicted on an exaggerated scale in FIG. 1 for the sake of clarity may occasionally be present.

During operation, when a shuttle 5 enters the catcher mechanism housing 1 at the end of a pick, trailing a weft yarn 26, the shuttle 5 is braked principally by the primary brake 2, so that a forward end or tip 27 of the shuttle 5 normally stops somewhere in the zone A. FIG. 1 shows in solid lines a shuttle 5 which is passing beneath and being braked by the primary brake 2. The stop position of the shuttle is shown at 5*a* in chain-dotted lines. For comparison purposes, a shuttle 5*b* is shown in broken lines after advancing to the innermost position B, the tip thereof being in contact with the push-back member 22, push-back member 22 being shown in an initial position.

Push-back member 22 is then moved to the right in FIG. 1 into the position 22*a* shown in dot-dash lines, so that the shuttle 5 is always pushed back to the same yarn release position C. During the push-back movement of the shuttle 5, the sensing element 11 is urged downwards under the action of the spring 16 in order to sense the shuttle 5 sliding on the shuttle 5 and then the push-back member 22. Foot 18 of sensing element 11, and specifically the inclined surface 31, slides along the free end 32 of the spring 24. The clearance 40 previously discussed may now be substantially eliminated.

The sensing element 11 is then raised back to the initial position as shown in FIG. 1 after the shuttle has entered the catcher mechanism by a known mechanism, for example as described in U.S. Pat. No. 2,538,798. The weaving machine thus continues operation, since the shuttle 5 has properly entered the catcher mechanism.

The shuttle is then ejected from the ejection position in a direction perpendicular to the drawing plane so that a following shuttle may enter the catcher mechanism.

If, for some reason, no shuttle 5 enters the catcher mechanism, the sensing element 11 is moved into the entry path 4 during the sensing movement. The push-back member 22 then engages the foot 18 of the sensing element 11 during the push-back movement in zone A. In this manner, the sensing element 11 is pivoted by the push-back member 22 in a counterclockwise direction about the clearance 13 against the force of the spring 24. Foot 18 is moved to the right in FIG. 1. As a result of the downward movement of the sensing element 11, a stop motion (not shown) is actuated by means of additional parts (not shown) so that operation of the weaving machine is stopped. The operator is then enabled to correct the fault in the picking system.

If shuttle 5 stops with the tip 27 in front of the sensing element 11 (see dotted-line position 27*b*), e.g. as a result of too intensive braking by the brake 2 or due to inadequate entry speed or the like, the weaving machine is similarly stopped because of the downward movement of sensing element 11. When the right-hand portion of the shuttle 5 has not entered the catcher mechanism, there is then a risk of collision with other parts (not shown) disposed outside the catcher mechanism 1, e.g. a selvage yarn clip, a reed, and so on. Accordingly, in such a situation it is desirable to stop the operation of the weaving machine until the operator corrects the fault.

Referring to FIG. 3, wherein like reference characters indicate like parts as above, the sensing element 11*a* may be located in a guide 35 of the housing 1 and carries a pivotally mounted sensing member 18*a* in the form of a foot via a pivot 36 at the sensing portion on the lower end. If the push-back member 22 engages the foot 18*a*, the latter is pivoted against the force of spring 24 into the inclined position 18*b* shown in FIG. 4.

In the examples described, the sensing element 11, 11*a* is disposed in the push-back zone A of the path of push-back member 22. Consequently, the speed of the weaving machine may be increased and the end of the picking movement may be located at a higher main shaft angle relative to the other operations in the cycle. Sensing is also accomplished at a later time relative to the other operations in the cycle.

For comparison purposes it should be pointed out that with prior art catcher mechanisms, the sensing element is disposed farther to the right, i.e. approximately at the position of spring 24 in FIGS. 1 and 2.

Figure 4:
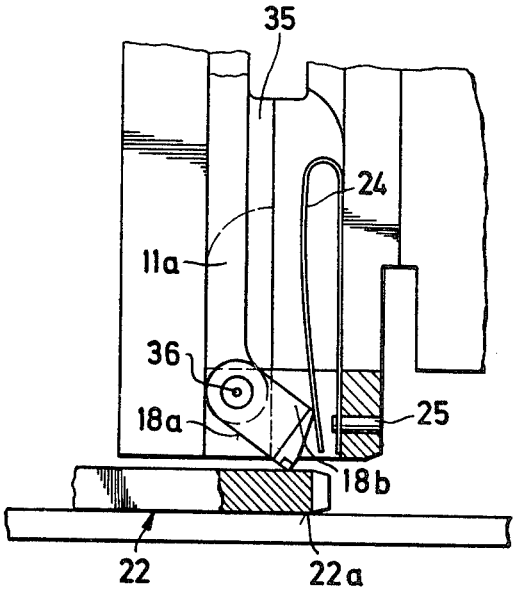
FIG. 4 is a fragmentary enlarged elevation view depicting the push-back member of FIG. 3 engaging the lower portion of the sensing member.
Figure 5:
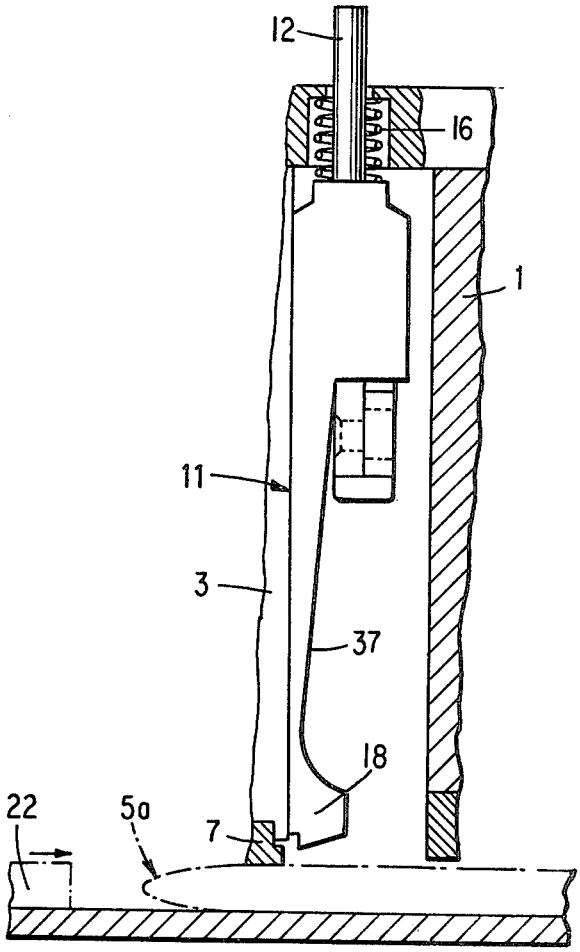
FIG. 5 illustrates an elevational view of a resilient sensing element.

In another embodiment of this invention, the entire sensing element 11 is made resilient, e.g. by providing a flexible part 37 shown in broken lines in FIG. 4 wherein like reference characters indicate like parts as above so as to flex under engagement with the push-back member 22. The material from which the sensing element 11 is made may be correspondingly resilient. This is achieved, for example, by using a suitable plastic.

Thus, there has been described an improved catcher mechanism in which the sensing element location permits greater travel of the picking means prior to sensing. This accordingly, allows for a higher speed operation of the weaving machine. It is noted that in certain instances, the additional brake 3 may be eliminated or deactivated.

What is claimed is:

1. A catcher mechanism for a gripper shuttle comprising a housing;

a braking means in said housing for braking a gripper shuttle into a stop position;

a push-back member in said housing for pushing a stopped gripper shuttle from a stop position into a yarn release position;

a spring member mounted in said housing; and a sensing element mounted within an opening in said housing for movement into the path of a gripper shuttle, said sensing element being mounted adjacent said spring member whereby said sensing element is adapted to be pressed against said spring element by said push-back member in the direction of a push-back movement of said push-back member in the absence of a gripper shuttle.

2. A catcher mechanism according to claim 1 wherein the sensing end of said sensing element is pivotally movable with respect to the remainder of said sensing element and is adapted to be pressed against said spring which permits pivoting thereof.

3. A catcher mechanism according to claim 1 which further includes a stop member for limiting the travel of said spring member in order to relieve said sensing element of load under normal operation.

4. A catcher mechanism for a weft picking means of a weaving machine, said mechanism comprising a braking means for braking a weft picking means to a stop position;

5. A catcher mechanism as set forth in claim 4 wherein said sensing element is amde of resilient material to flex under engagement with said push-back member.

6. A catcher mechanism for a weft picking means of a weaving machine, said mechanism comprising a braking means for braking a weft picking means to a stop position;

a push-back member for pushing a stopped weft picking means located in a push-back zone into a yarn release position;

a sensing element for sensing the presence of a weft picking means in said push-back zone, said sensing element having a sensing portion disposed for movement into said push-back zone to sense a picking means therein and to be engaged by and moved with said push-back member during movement of said push-back member towards said yarn release position in the absence of a picking means therein; and a spring adjacent said sensing element for resiliently engaging said sensing element upon movement of said sensing element in said push-back zone.

7. A catcher mechanism for a weft picking means of a weaving machine, said mechanism comprising a braking means for braking a weft picking means to a stop position;

a push-back member for pushing a stopped weft picking means located in a push-back zone into a yarn release position;

a sensing element for sensing the presence of a weft picking means in said push-back zone, said sensing element having a pivotally mounted sensing member disposed for movement into said push-back zone to sense a picking means therein and to be engaged by and moved with said push-back member during movement of said push-back member towards said yarn release position in the absence of a picking means therein; and a spring adjacent said sensing member for resiliently engaging said sensing member upon movement of said sensing member in said push-back zone.

* * * * *

UNITED STATES PATENT AND TRADEMARK OFFICE

CERTIFICATE OF CORRECTION

PATENT NO. : 4,192,354

DATED : March 11, 1980

INVENTOR(S) : Erwin Pfarrwaller

It is certified that error appears in the above—identified patent and that said Letters Patent is hereby corrected as shown below:

Column 5, lines 28 - 31, claim 4, insert the following:

--a push-back member for pushing a stopped weft picking means located in a push-back zone into a yarn release position; and a sensing element for sensing the presence of a weft picking means in said push-back zone, said sensing element having a resilient sensing portion disposed for movement into said push-back zone to sense a picking means therein and to be engaged by and resiliently moved with said push-back member during movement of said push-back member towards said yarn release position in the absence of a picking means therein.--

UNITED STATES PATENT AND TRADEMARK OFFICE

CERTIFICATE OF CORRECTION

PATENT NO. : 4,192,354

DATED : March 11, 1980

INVENTOR(S) : Erwin Pfarrwaller

It is certified that error appears in the above—identified patent and that said Letters Patent is hereby corrected as shown below:

Column 3, line 33, change "of" to --at--

Column 3, line 35, change "spring" to --sensing--

Column 5, line 33, change "amde" to --made--

Signed and Sealed this

*Twenty-second* Day of *July 1980*

[SEAL]

*Attest:*

SIDNEY A. DIAMOND

*Attesting Officer*

*Commissioner of Patents and Trademarks*